US007195243B2

(12) United States Patent
Kenny et al.

(10) Patent No.: US 7,195,243 B2
(45) Date of Patent: Mar. 27, 2007

(54) PLAY FOUR POKER

(75) Inventors: James T. Kenny, Shorewood, IL (US); Larry Kekempanos, Oak Lawn, IL (US)

(73) Assignee: Kings Gaming, Inc., Oak Lawn, IL (US)

( * ) Notice: Subject to any disclaimer, the term of this patent is extended or adjusted under 35 U.S.C. 154(b) by 0 days.

(21) Appl. No.: 10/748,602

(22) Filed: Dec. 30, 2003

(65) Prior Publication Data

US 2004/0150163 A1 Aug. 5, 2004

Related U.S. Application Data

(63) Continuation-in-part of application No. 10/100,359, filed on Mar. 18, 2002, now abandoned.

(60) Provisional application No. 60/314,503, filed on Aug. 23, 2001, provisional application No. 60/277,018, filed on Mar. 19, 2001.

(51) Int. Cl.
*A63F 1/00* (2006.01)

(52) U.S. Cl. ..... 273/292; 463/13

(58) Field of Classification Search ..... 273/292, 273/274, 309; 463/13
See application file for complete search history.

(56) References Cited

U.S. PATENT DOCUMENTS 5,377,993 A 1/1995 Josephs
5,685,774 A * 11/1997 Webb ..... 463/13
5,865,437 A 2/1999 Moore, Jr.
6,056,641 A 5/2000 Webb
6,098,984 A 8/2000 Moore, Jr.
6,098,985 A 8/2000 Moody
6,102,402 A * 8/2000 Scott et al. ..... 273/292
6,237,916 B1 * 5/2001 Webb ..... 273/292
6,334,614 B1 1/2002 Breeding
6,345,823 B1 2/2002 Webb
6,478,675 B1 * 11/2002 Awada ..... 463/13
6,517,074 B1 2/2003 Moody et al.
6,568,680 B1 5/2003 Moody et al.
6,652,377 B1 11/2003 Moody
6,698,759 B2 3/2004 Webb et al.
6,869,076 B1 3/2005 Moore et al.
6,923,446 B2 8/2005 Snow
6,955,356 B2 10/2005 Moody
6,959,928 B2 11/2005 Schultz
6,964,418 B2 11/2005 Moody

OTHER PUBLICATIONS

"Show Five Cards", Scarne's Encyclopedia of Games, John Scarne, Harper & Row Publishers, 1973, pp. 28-29.*

* cited by examiner

*Primary Examiner*—Benjamin Layno
(74) *Attorney, Agent, or Firm*—Banner & Witcoff, Ltd.

(57) ABSTRACT

A method of playing a four-card poker game by at least one player and a banker who is preferably also the dealer. The player has the option to wager against the dealer, wager against a predetermined payout schedule, or both. Additional options of a progressive wager and/or a bad beat wager are also possible with the present game.

8 Claims, 8 Drawing Sheets

PAIR OF JACKS OR BETTER PAYS

| | |
|---|---|
| PAIR OF JACKS OR BETTER | 1 TO 1 |
| TWO PAIR | 2 TO 1 |
| THREE OF A KIND | 3 TO 1 |
| STRAIGHT | 4 TO 1 |
| FLUSH | 4 TO 1 |
| STRAIGHT FLUSH | 25 TO 1 |
| FOUR OF A KIND | 75 TO 1 |
| ROYAL FLUSH | 200 TO 1 |

FIG. 2

A PAIR OF QUEENS OR BETTER.....1 TO 1
TWO PAIR.....2 TO1
THREE OF A KIND.....4 TO 1
STRAIGHT.....4 TO 1
FLUSH.....4 TO 1
STRAIGHT FLUSH.....40 TO 1
FOUR OF A KIND.....100 TO 1
ROYAL FLUSH.....250 TO 1

FIG. 3

ANTE REWARD PAYS

| | |
|---|---|
| STRAIGHT FLUSH | 3 TO 1 |
| FOUR OF A KIND | 8 TO 1 |
| ROYAL STRAIGHT FLUSH | 20 TO 1 |

FIG. 4

ANTE PAYS 1 TO 1

PLAY PAYS 1 TO 1

FIG. 6

| BAD BEAT HAND | PAYS (TO 1) |
|---|---|
| FOUR OF A KIND | 10,000 |
| STRAIGHT FLUSH | 2,000 |
| FLUSH | 250 |
| STRAIGHT | 100 |
| THREE OF A KIND | 75 |
| TWO PAIR | 25 |

FIG. 7

| BAD BEAT HAND | PAYS (TO 1) |
|---|---|
| FOUR OF A KIND | 20,000 TO 1 |
| STRAIGHT FLUSH | 5,000 TO 1 |
| FLUSH | 1,000 TO 1 |
| STRAIGHT | 300 TO 1 |
| THREE OF A KIND | 250 TO 1 |
| TWO PAIR | 100 TO 1 |

FIG. 8

PLAY FOUR POKER

CROSS-REFERENCE TO RELATED APPLICATIONS

This application is a continuation in part of application Ser. No. 10/100359 filed on Mar. 18, 2002 now abandoned identifying James Thomas Kenny and Larry E. Kekempanos as co-inventors, which is in turn filed in connection with and claiming the benefit of U.S. Provisional Application No. 60/277,018 filed on Mar. 19, 2001 and U.S. Provisional No. 60/314,503 filed on Aug. 23, 2001 identifying James Thomas Kenny and Larry E. Kekempanos as co-inventors.

BACKGROUND OF THE INVENTION

The present invention relates to gaming and to card games. More particularly, the present invention pertains to a method of playing a new type of poker game especially adapted for casino gaming, both in live table and electronic video formats.

Gaming establishments continually require new games to offer their players. Casinos are also in need of games which are easy to play and easy to deal. Such games are generally required to enable each player to play against a banker (who usually also acts a dealer) provided by a casino, rather than against other players. This type of Casino Poker can provide more revenue to the casino than traditional poker because Casino Poker is invariably structured to give the casino an advantage. Exemplary of Casino Poker are the casino games of "Caribbean Stud Poker", "Let It Ride", and "Three Card Poker". These type games require less space than the traditionally larger tables found in poker rooms and are dealt much faster.

In games like Caribbean Stud and Let It Ride, the five card poker hands that the player must make to get a larger payoff are hard to get thus the larger payoffs are infrequent. The player is frustrated because many times they will get four cards to a straight or a flush but not have a good hand. In a three-card game like Three Card Poker, the higher hands are made more easily but therefore the payouts are comparatively low. Therefore, there is a need for a game, which would bridge the gap in ease of making a hand with higher payouts to the player.

In addition, as will be more apparent from the following specification, and as was more fully delineated in our provisional application filed Aug. 23, 2001, it has been determined that the player interest is increased when the odds of the player being able to achieve a winning hand are increased. This, of course, must be balanced against the player/dealer/casino having good odds in winning as well. It is clear that with five card poker games, the odds of achieving a good hand are more difficult than in a lessor number card game. As has been indicated above, in a three-card poker game, the ability to achieve a good hand is enhanced and therefore the payoffs are less. The present invention seeks to provide a card game, which now focus's on a four-card poker game and as will be demonstrated hereinafter, improves the odds for the player to win, while still maintaining good odds for the casino as well. It will also be appreciated that the over all odds for a player winning in a four card game are easier than the odds for a player to win any five card poker game.

Insofar as the prior art is concerned, the art is particularly void of any disclosures or showings of a four card poker game. Similar games are disclosed, but they relate to either a three card game, or a five card game. Furthermore, some of the games disclosed in the prior art are played with in excess of 52 cards and hence, have a different basis for play and a different statistical odds for the player being able to achieve a winning hand. For example, the patent to Goldman, U.S. Pat. No. 5,997,002 discloses a poker style casino card game which uses a 52 card standard playing deck plus an additional five jokers for a total of 57 cards. Play consists of dealing 5 cards to each player, and in the preferred embodiment, are dealt face down. The game is played by the dealer revealing a first card, and a player revealing a first card, then deciding on additional wagers. The sequence of the game terminates when all five cards are displayed, assuming each player has stayed in the game, comparing the best five card hand of the dealer against each players five cards. Goldman also reveals that jokers which are part of the deck are never wild and hence, a player receiving a joker ends up in a poor position since one of the five cards cannot count towards the making of a poker hand. Goldman fails to reveal any capability to make a four card flush or straight.

Another prior art patent discloses a poker game which indicates a game for either a three card or five card poker hand. The patent to Webb U.S. Pat. No. 5,685,774 discloses a card game which may be played in either a three card variation, or a five card variation. While the patent mentions a four card version of the game, in the four card version each player will receive a wild card which the player may place with the four card hand in order to make a five card poker hand. Hence, the wagering system is dependent upon a five card hand or a three card hand, and is not dependent on the best hand with four cards. Again, Webb fails to disclose a four card capability to make a four card flush or straight.

The patent to Scott U.S. Pat. No. 6,102,402 describes still another variation of a poker game which is played as a five card face down game. The players five card hand is compared to the dealers five card hand to determine the wagering outcome. Once again, Scott fails to disclose or appreciate a four card poker game.

OBJECTS AND ADVANTAGES OF THE INVENTION

It is an object of the present invention to provide an enjoyable new card game.

It is a further object of the present invention to provide a game that is easy to learn and deal.

It is a further object of the present invention to provide a game that makes it easier for a player to make a hand than in a five-card game, and hence enhances the odds of the player being able to win a four-card game versus a five-card game.

It is a further object of the present invention to provide a game that has higher payoffs than a three-card poker game since the odds are harder in any four-card game than they are in a three-card game at least for the top hands, but nevertheless still maintains the player interest due to enhanced ability to obtain a winning hand versus a five-card poker game.

SUMMARY OF THE INVENTION

The present invention discloses a poker game variation in which one or more players play against the casino. Broadly, the invention is directed to a poker game variant in which a player has a choice between several wagers among the following; a wager against a dealer, a wager against a pre-determined payscale, a bad beat wager, or a progressive wager.

In one preferred embodiment of the invention, one or more players initially place a wager(s) and then five cards are dealt to the player and five cards are dealt to the dealer. Players would inspect their hands and decide whether to fold or to continue to play. If the player was playing a wager against the dealer and wanted to continue to play, they would place another wager in support of their first wager in the appropriate betting area. The dealer would inspect his/her hand to see if they qualified. If the dealer did not qualify with a pre-determined rank of cards, the dealer would pay the first wager of the player and return the supporting wager. If the dealer had a qualifying hand, then the player and the dealer would compare their best four-card hand to determine the winner. Tie hands would be a push. If the player had also made a wager against the dealer and had supported that wager, and the player's outranks the dealer, they would be eligible for a payoff for achieving a winning hand. If the player had also made any wagers against achieving a pre-determined rank, and achieves such a rank, the player would win that wager accordingly.

In a second embodiment of the invention, one or more players initially place bets and then five cards are dealt to the player and six cards are dealt to the dealer. Players would inspect their hands and decide whether to fold or to continue to play. If the player was playing a wager against the dealer and wanted to continue to play, they would place another wager in support of their first wager in the appropriate betting area. In games against the dealer, the player would play their best four-cards out of five and compare that to the dealer's best four cards out of six to determine the winner. Tie hands would be a push. In this version the dealer would not have to have a qualifying hand to continue play. If the player had made any optional wagers against achieving a pre-determined rank, the dealer would pay or take the wagers accordingly.

In a third embodiment of the invention, one or more players initially place bets and then four cards are dealt to the player and four cards are dealt to the dealer. Players would inspect their hands and decide whether to fold or to continue to play. If the player was playing a wager against the dealer and wanted to continue to play, they would place another wager in support of their first wager in the appropriate betting area. In games against the dealer, the player would play their four cards against the four cards of the dealer. The dealer would have to achieve a qualifying hand to continue play against the player. If the player had made any bets against achieving a pre-determined rank, the dealer would pay or take the bets accordingly.

It is contemplated that in the game of the present invention, for the game to begin, either the player or the dealer must have at least a minimum hand ranking for the game to proceed. The casino or house may vary the rules by requiring the dealer to have a qualifying hand, if he doesn't, he loses the initial bet to the player, or on the other hand, if the house requires that the player must have a qualifying hand, and the player fails to achieve a qualifying hand, he loses his initial bet. The game may, of course, be played without requiring any of the participants to have a qualifying hand in order for the game to commence A novel gaming layout for use in the casino version of the game is also disclosed.

There has thus been outlined, rather broadly, the more important features of the invention in order that the detailed description thereof that follows may be better understood, and in order that the present contribution to the art may be better appreciated. There are of course, additional features of the invention that will be described hereafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent construction insofar as they do not depart from the spirit and scope of the present invention.

BRIEF DESCRIPTION OF THE DRAWINGS

FIG. 2 is a chart indicating winning poker hands and their payouts in one example of a wager against a predetermined payscale of the present invention;

FIG. 3 is a chart indicating winning poker hands and their payout in another variation of a wager against a predetermined payscale of the present invention;

FIG. 4 is a chart indicating the winning hands and their payouts for the Ante Reward of one embodiment of the present invention;

FIG. 6 is a chart indicating payoffs for the Ante and Play wagers;

FIG. 7 is a chart indicating payoffs for the bad beat hand as one variation;

FIG. 8 is a chart indicating payoffs for a bad beat hand as to an alternate variation.

DETAILED DESCRIPTION OF THE PREFERRED EMBODIMENT

According to a preferred embodiment of the present invention, players play against a casino. However, in jurisdictions where such games are not legal, such as in California, one player may be designated "Player-Dealer" and all the other players would play against the Player-Dealer. The option to act as Player-Dealer would be offered to each player in turn. In this specification, the term "Dealer" is intended to refer to either a casino dealer, or a Player-Dealer, whichever is appropriate for the circumstances under which the game of the present invention is played.

Figure 1:
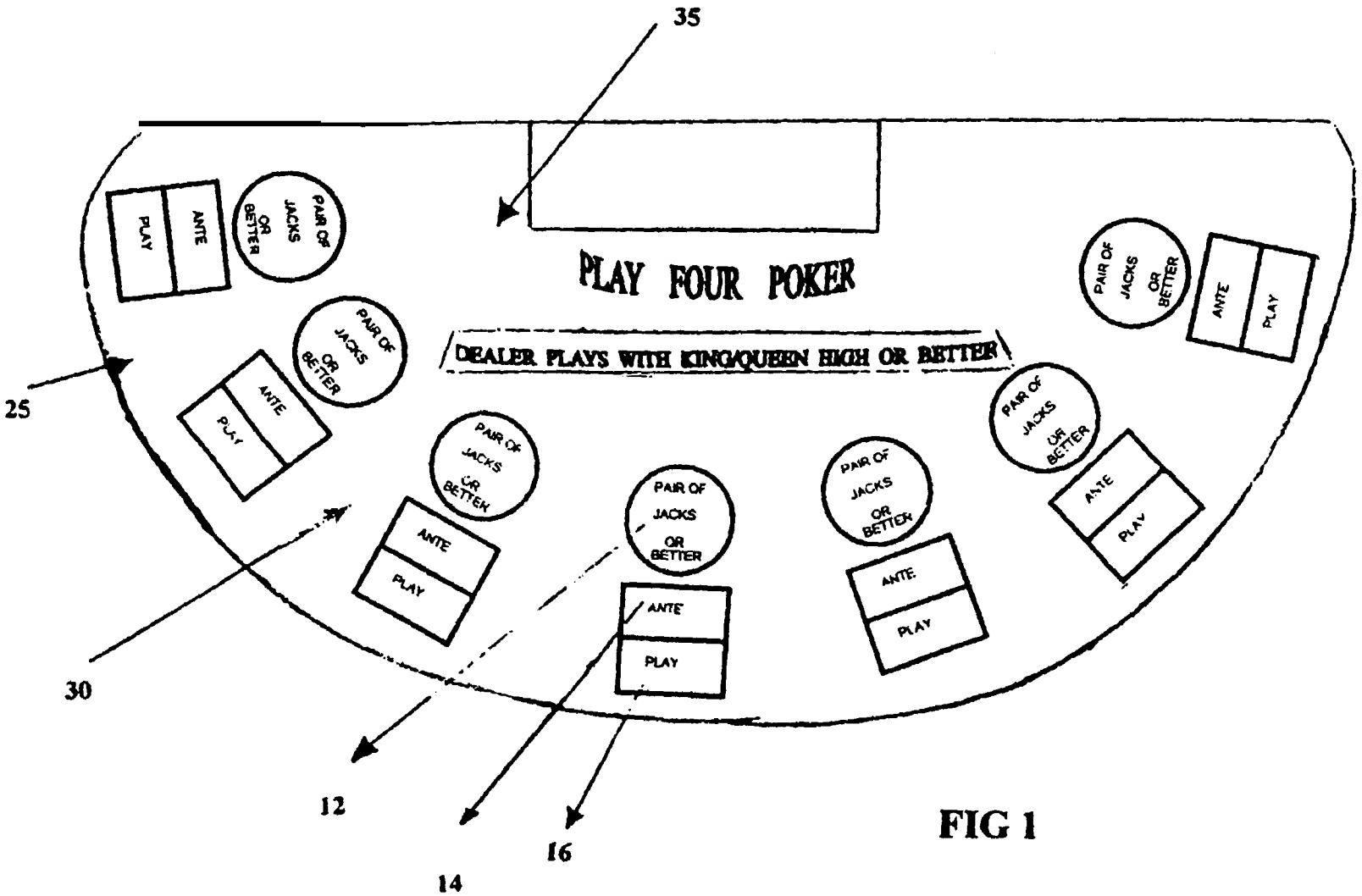
FIG. 1 shows a playing surface for use in playing a card game of one embodiment of the present invention.
Figure 5:
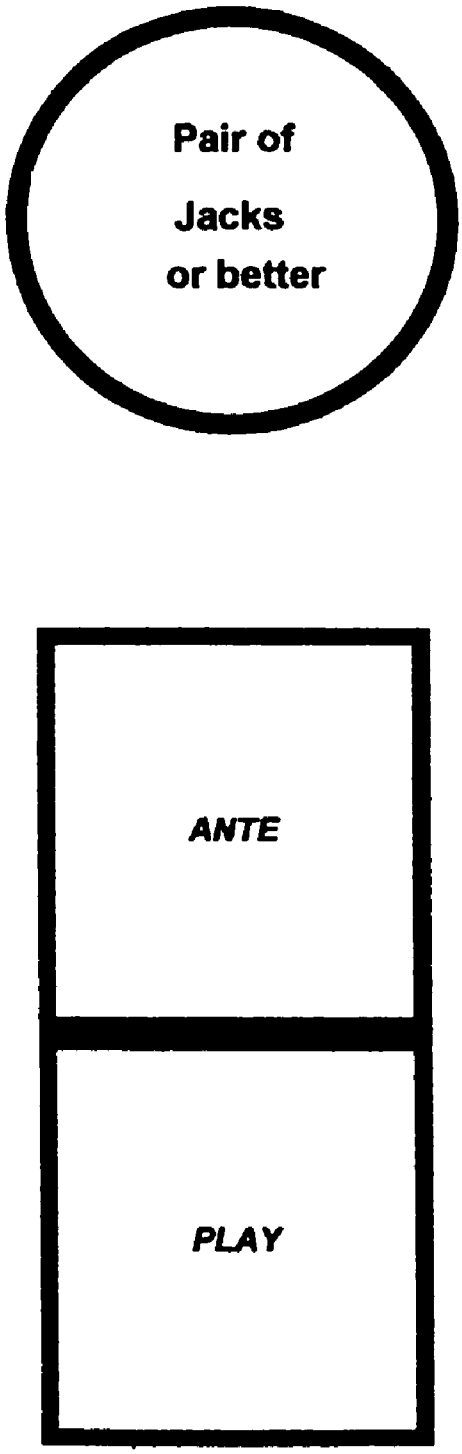
FIG. 5 illustrates one player area of the playing surface shown in FIG. 1.

FIG. 1 shows a playing surface or table layout 25 on which one embodiment of the present invention may be played. The layout 25 may be marked or placed on any suitable surface such as a gaming table. For example, the layout may be in the form of a layout cloth supported on a supporting surface. The layout provides a playing area 30 for a plurality of players, for example seven players, and a separate area 35 for a banker who also preferably acts as the dealer. Each playing area 30 has a number of marked sections or zones 12, 14, 16 for the placing of various wagers by a player as will be described hereinafter.

Each player takes a place at one of the playing areas 30. The game is played in a number of rounds as will be described. In each round, each player has the option of playing against the dealer, or wagering on the rank of his/her hand or playing a combination of these two options. In other variations of the game a player may have additional betting options. The presently preferred embodiment of the present invention is played with a standard deck of 52 playing cards, each deck having 13 cards in each of four suits.

At the commencement of the game each player decides whether to play the particular round by wagering against the dealer, i.e. an "ANTE" wager, by wagering on the value of his/her hand, i.e. a "Pair of Jacks or Better" wager, or both. To play against the dealer a player makes an Ante wager by placing an appropriate wager, such as a token or chip, or where permitted, cash, on the section 14 of his/her playing area 30. The gaming chips may be of any conventional kind and available in a number of denominations such as are well known within the art. If the player wishes (alternatively or in addition) to make a wager based on the value of his/her hand, the player places an appropriate token or chip on "Pair of Jacks or Better" in section 12 of his/her playing area 30. In the present example, the rules of the game provide that payouts will be made according to a displayed payout schedule with "Pair of Jacks or Better" payouts starting at a pair of jacks or better. In one embodiment of the present invention, hands are preferably ranked according to the following hierarchy, though other rankings may be used:

| Highest: | |
|---|---|
| Royal Flush: | AKQJ in the same suit (suit has no rank) |
| Four of a Kind: | Four of one rank<br>AAAA highest<br>KKKK next highest ranking four of a kind, and so on until<br>2222 lowest ranking four of a kind |
| Straight Flush: | Four of one suit in sequence<br>KQJ10 highest ranking straight flush<br>QJ109 next highest ranking straight flush, and so on until<br>4, 3, 2, A lowest ranking straight flush |
| Flush | Four of one suit<br>AKQ10 highest ranking<br>AKQ9 next highest ranking, and so one, until<br>532A lowest ranking straight |
| Straight | Four in sequence, not all of one suit<br>AKQJ highest ranking<br>KQJ10 next highest ranking, and so on until<br>4, 3, 2, A lowest ranking straight |
| Three of a Kind: | Three of one rank<br>AAA highest<br>KKK next highest rank, and so on until<br>222 lowest ranking three of a kind |
| Two Pair: | Two different, two of same rank<br>AAKK highest-ranking two pair<br>AAQQ next highest ranking two pair, and so on until<br>3322 lowest ranking pair |
| One Pair: | Two of one rank<br>AAKQ highest<br>AAKJ next highest ranking pair, and so on until<br>4322 lowest ranking pair |
| High Card: | (A hand comprising none of the above)<br>AKQ10 highest<br>AKQ9 next highest ranking high card, and so on until<br>6432 lowest ranking high card |

Ace is high, but can be low in 4-3-2-A Sequence.

The payout schedule may be varied in accordance with the rules of the game and/or the casino. For example, another version of the game may eliminate the royal flush hand and have the following rankings:

Four of a Kind

Straight Flush

Three of a Kind

Flush

Straight (A–2–3–4 is the lowest straight)

Two Pair

One Pair

High Card

One of the wagering options in one embodiment of the present invention is a "Pair of Jacks or Better". An example of one preferred payout schedule for that wager is as follows:

| PAIR OF JACKS OR BETTER PAYS | |
|---|---|
| PAIR OF JACKS OR BETTER | 1 TO 1 |
| TWO PAIR | 2 TO 1 |
| THREE OF A KIND | 3 TO 1 |
| STRAIGHT | 4 TO 1 |
| FLUSH | 4 TO 1 |
| STRAIGHT FLUSH | 25 TO 1 |
| FOUR OF A KIND | 75 TO 1 |
| ROYAL FLUSH | 200 TO 1 |

Another of the wagering options in a second embodiment of the present invention is a "Pair of Queens or Better". An example of one preferred payout schedule for that wagers is as follows:

| PAIR OF QUEENS OR BETTER PAYS | |
|---|---|
| PAIR OF QUEENS OR BETTER | 1 TO 1 |
| TWO PAIR | 2 TO 1 |
| THREE OF A KIND | 4 TO 1 |
| STRAIGHT | 4 TO 1 |
| FLUSH | 4 TO 1 |
| STRAIGHT FLUSH | 40 TO 1 |
| FOUR OF A KIND | 100 TO 1 |
| ROYAL FLUSH | 250 TO 1 |

The payout schedules are preferably displayed in a convenient manner and location. At times the payscales for different wagers and any extra reward payouts will be displayed on the playing layout itself and at other times the payouts will be on mobile display material.

According to a preferred embodiment of the present invention, the two wagering options are independent, so that a player may wager unequal amounts on the ANTE and PAIR OF JACKS OR BETTER options.

When the above wagers are in place, the dealer preferably shuffles the cards (manually or otherwise) and then deals a five-card hand to each player and him/herself.

The cards may initially be dealt to the players face up or face down depending upon casino policy.

When the cards have been dealt, any player who has placed an ANTE wager inspects his/her hand and determines whether he/she wishes either to fold and forfeit the ANTE wager, or to continue. If the player wishes to continue, according to this illustrated embodiment, the player must place a PLAY wager, which may be of proportionate value to and is preferably the same as the ANTE wager. The PLAY wager is made by placing an appropriate chip on the section 16 marked "PLAY" on the player's playing area 30. When the player has made the wager then he/she places the cards in the PLAY area below the PLAY wager section 30.

If a player forfeits his/her ANTE wager, the dealer takes the wager and the player's cards are discarded before the game proceeds.

"PAIR OF JACKS OR BETTER" wagers are not affected to this point. However, a player playing "PAIR OF JACKS OR BETTER" only, places his/her cards in the playing area if they wish to continue the hand. If the player wishes to forfeit or fold their hand they would indicate such by tossing their hand towards the dealer. If the player is also playing against the dealer with an ANTE wager, he/she must make a PLAY wager if he/she has a winning PAIR OF JACKS OR BETTER wager.

The dealer reveals his/her cards and arranges the cards to show the best four-card poker hand. The dealer then in turn reveals each other player's cards (if they are not already visible), compares the player's best four card poker hand to that of the dealer, and resolves each player's best four card poker hand to that of the dealer, and resolves each player's wager(s).

All players with ANTE and PLAY wagers are automatically winners if the dealer does not have a KING/QUEEN high hand or better. This rank may be varied in accordance with the rules of the game or of the casino. Players are preferably paid even money on the ANTE wager and their PLAY wager is returned.

If the dealer has a KING/QUEEN high hand or better, each player's hand is compared with that of the dealer. If the player's hand is higher, the player is paid even money on both the ANTE and PLAY wagers. If the player's hand is lower, the player loses his/her ANTE and PLAY wagers. If the dealer and player have exactly the same hand, then the hand is a push and the player may either withdraw his/her wager, leave it, or adjust it for the next round.

The present game may also provide for an additional payout to be made by the dealer, to the player who is in play against the dealer i.e. who has made an ANTE and PLAY wager, if the player achieves a hand listed on an additional pay-out schedule. As was previously indicated, additional wagers may be provided for in the present game and in this connection, there would be provided a payout schedule indicating a certain ranking of winning hands and a payout amount should the player achieve such a hand. The ranks to which such extra ANTE REWARD payouts are made may be predetermined by the rules of the game and/or the casino. The payouts would preferably be based on the ANTE wager amount. These payouts are independent of the results of the game against the dealer. One preferred payoff schedule is as follows:

| ANTE REWARD PAYS | |
|---|---|
| STRAIGHT FLUSH | 3 TO 1 |
| FOUR OF A KIND | 8 TO 1 |
| ROYAL STRAIGHT FLUSH | 20 TO 1 |

Players who have wagered on the value of the hand (i.e. PAIR of JACKS or BETTER) win if the hand is at least a pair of jacks and are paid by the dealer according to the posted payscale. These payouts are independent of the results of the game against the dealer.

This procedure completes a single round of the game. Play then continues in another round, with players commencing by making ANTE and/or PAIR of JACKS or BETTER wagers.

The novel methods of the present invention may be played utilizing playing cards or as an electrical or electromechanical device such as a slot machine. Those skilled in the art will appreciate that suitable controls can be provided for receiving the necessary input and therefore will not be described in detail herein. While the game may be played on a single slot machine, it is within the scope of the present invention to provide a multi-unit video format wherein a plurality of players may play against each other and/or against a dealer.

From the present description, those skilled in the art will appreciate that various modifications may be made without departure from the scope of the present invention. For example, the naming of the different wagers, the naming and/or ranking of any hand, the changing of the necessity of qualifying hands for both the dealer and/or the player, the payout schedules, and predetermined winning or losing ranks may be varied in accordance with the rules of the game or the requirements of the casino. The table game layout may be varied from what is described and shown. The rules may be varied, or additional rules imposed, within the scope of the invention. Additional optional bets may be incorporated into the game with a view toward enhancing the players interest and ability to win additional wagers. One such additional optional bet may be termed a "BAD BEAT SIDE BET". As indicated previously, once the player has placed a first ANTE wager against the dealer and supported that with a third support wager know as a PLAY wager, the player may optionally place a wager on a "BAD BEAT SIDE BET" which wagers against another predetermined payout schedule. In such an instance, the player is wagering that the player can achieve a hand which appears on the payout schedule even if the player's hand is ultimately outranked by the dealer's hand. For example, if the player has 2 pair or better and is outranked by the dealer, the player would receive a bad beat bonus according to the payout schedule which for example may take the following format:

| Bad Beat Hand | Paid (to 1) |
|---|---|
| 4 of a Kind | 10,000 |
| Straight Flush | 2,000 |
| Flush | 250 |
| Straight | 100 |
| Three of a Kind | 25 |
| Two Pair | 25 |

Hence, even if the dealer has a hand which outranks the player such that the player would lose both the ANTE bet and the PLAY bet, the player may be able to win the side bonus bad beat bet if his hand still appears on the predetermined payout schedule.

The player would lose the optional bet in the event that his hand does not appear on the payout schedule and/or the player folds his hand and ceases playing.

It will be appreciated that additional marked zones may be provided to accommodate the optional additional and/or side bets. The marking of the betting zone would be noted accordingly so that the player would know where to position his chips in order to place a side bet.

It will therefore be appreciated that the precise wagering requirements may vary depending upon the casino rules, the nature of the game will remain the same, that is, a four card poker game wherein only four cards are used determining a winner or loser. The precise wagering system can be varied in that any number of additional and optional side bets may be incorporated into the game, or indeed, additional forced bets may be incorporated by the house rules. Surely, the wagering systems may vary dramatically without changing the nature of the card game described and claimed herein.

Hence, the precise method of wagering is not deemed to be a critical part of the present invention rather, the criticality of the present invention resides in the playing of a four card poker game.

The importance of the present invention resides in the fact that by producing and developing a four card poker game, the game is enhancing the odds of the player in the possibility of obtaining a winning hand. From a mathematical stand point, following below is a detailed format showing the odds of a player being able to win a four card poker game versus a five card game.

Five Card Stud Compared to Play Four Poker

| HAND | Odds to 1 of making 2,598,960 combinations Column 1 5 - Card Poker | Column 2 Play Four Poker | (Column 1 ÷) (Column 2 ) Easier to Make |
|---|---|---|---|
| Royal Flush | 649,740 | 13,535 | 48 |
| Straight Flush | 72,193 | 1,382 | 52 |
| Four of a Kind | 4,165 | 4,165 | same |
| Full House | 694 | 0 | (No Full House) |
| Flush | 508.8 | 22.6 | 22.5 |
| Straight | 254.8 | 25.5 | 9.9 |
| Three of a Kind | 47 | 44.3 | 1.06 |
| Two Pair | 21 | 21 | same |

Mathematical Analysis

There are 2,598,960 ways to deal five cards to the player from a deck of 52 cards and 1,533,939 ways to deal five cards to the dealer from the remaining 47-card deck. Thus there are 2,598,960×1,533,939=3,986,646,103,440 ways to deal a game.

A computer program was written to deal all unique player-dealer hand combinations. An arbitrary dealer qualifying hand was predetermined. The player and dealer hands were then compared and the results were noted down. The house advantage was then calculated from the saved results. The dealer qualifying hand was then adjusted until an ideal house advantage could be attained. It turned out that a dealer qualifying hand of KQ-high would yield a house advantage of 3.219%. The hand distributions for both the player and dealer are shown below:

Player and dealer final hand distributions (%)

| Final Hand | Probability |
|---|---|
| Royal Flush | 0.0074 |
| Four of a Kind | 0.0240 |
| Straight Flush | 0.0723 |
| Flush | 4.4101 |
| Straight | 3.9173 |
| Three of a Kind | 2.2569 |
| Two Pair | 4.7539 |
| One Pair | 40.3066 |
| KQ-high | 21.4978 |
| Nothing | 22.7537 |

It can be seen from the above that the dealer should qualify 77.2483% of the time. The player will fold 29.1943% of the time, thus averaging 1.7081 bets per hand. The house advantage is 3.2190% per initial wager or 1.8846% per total wager.

The optimal strategy is to only play any hand better than A–10–6–3–2 with 113 exceptions as shown in the Appendix.

It should be noted that although a three-of-a-kind occurs less often than a flush and a straight, it is still ranked lower than a flush and a straight in Play Four Poker so that the players who are familiar with the traditional poker ranking won't get confused.

Bonus Bet

Payout Schedule 1

| Final Hand | Probability in % | Pays (to 1) | Return % |
|---|---|---|---|
| Royal Flush | 0.007388 | 200 | 1.4775 |
| Four of a Kind | 0.024010 | 75 | 1.8007 |
| Straight Flush | 0.072337 | 25 | 1.8084 |
| Flush | 4.410072 | 4 | 17.6403 |
| Straight | 3.917259 | 4 | 15.6690 |
| Three of a Kind | 2.256903 | 3 | 6.7707 |
| Two Pair | 4.753902 | 2 | 9.5078 |
| Pair Jacks or Better | 12.438360 | 1 | 12.4384 |
| Total | 27.880229 | | 67.1128 |

The house advantage is 100%−27.8802%−67.1128%=5.0069%. About once every 3.8 hands the player will win the bet.

Payout Schedule 2

| Final Hand | Probability in % | Pays to (to 1) | Return % |
|---|---|---|---|
| Royal Flush | 0.007388 | 250 | 1.8469 |
| Four of a Kind | 0.024010 | 100 | 2.4010 |
| Straight Flush | 0.072337 | 40 | 2.8935 |
| Flush | 4.410072 | 4 | 17.6403 |
| Straight | 3.917259 | 4 | 15.6690 |
| Three of a Kind | 2.256903 | 4 | 9.0276 |
| Two Pair | 4.753902 | 2 | 9.5076 |
| Pair Queens or Better | 9.346662 | 1 | 9.3467 |
| Total | 24.788531 | | 68.3327 |

The house advantage is 100%−24.7885%−68.3327%=6.8788%. About once every 4 hands the player will win the bet.

| Payout Schedule 3 | | | |
|---|---|---|---|
| Final Hand | Probability | Pays (to 1) | Return % |
| Royal Flush | 0.007388 | 1000 | 7.388 |
| Four of a kind | 0.02401 | 250 | 6.0024 |
| Straight Flush | 0.072337 | 100 | 7.2337 |
| Flush | 4.410072 | 5 | 22.0504 |
| Straight | 3.917259 | 5 | 19.5863 |
| Three of a Kind | 2.256903 | 5 | 11.2845 |
| Total | 10.687969 | | 73.5453 |

The house advantage is 100%−10.6880%−73.8225%=15.4896%. About 1 in 9.4 hands the player will win the bet.

Bad Beat Side Bet

The computer analysis indicated that the player would be bad beat by the dealer as follows:

| Player Hand | Dealer Hand | Probability (%) |
|---|---|---|
| Four of a Kind | Royal Flush | 0.00000171 |
| Four of a Kind | Four of a Kind | 0.00000370 |
| Straight Flush | Royal Flush | 0.00000668 |
| Straight Flush | Four of a Kind | 0.00001674 |
| Straight Flush | Straight Flush | 0.00002831 |
| Flush | Royal Flush | 0.00035505 |
| Flush | Four of a Kind | 0.00102545 |
| Flush | Straight Flush | 0.00347447 |
| Flush | Flush | 0.10496533 |
| Straight | Royal Flush | 0.00031685 |
| Straight | Four of a Kind | 0.00089614 |
| Straight | Straight Flush | 0.00286725 |
| Straight | Flush | 0.17225544 |
| Straight | Straight | 0.07533523 |
| Three of a Kind | Royal Flush | 0.00016402 |
| Three of a Kind | Four of a Kind | 0.00063670 |
| Three of a Kind | Straight Flush | 0.00160643 |
| Three of a Kind | Flush | 0.09813261 |
| Three of a Kind | Straight | 0.08657776 |
| Three of a Kind | Three of a Kind | 0.02804452 |
| Two Pair | Royal Flush | 0.00034807 |
| Two Pair | Four of a Kind | 0.00133263 |
| Two Pair | Straight Flush | 0.00340865 |
| Two Pair | Flush | 0.20802501 |
| Two Pair | Straight | 0.18413489 |
| Two Pair | Three of a Kind | 0.11487296 |
| Two Pair | Two Pair | 0.11707336 |

| A Summary of Bad Beat Hands | | | | |
|---|---|---|---|---|
| Bad Beat Hand | Probability % | Odds Against | Pays | Return % |
| Four of a Kind | 0.00000541 | 18483392:1 | 10000 | 0.0541 |
| Straight Flush | 0.00005174 | 1932888:1 | 2000 | 0.1035 |
| Flush | 0.10982030 | 910:1 | 250 | 27.4551 |
| Straight | 0.25167090 | 396:1 | 100 | 25.1671 |
| Three of a Kind | 0.21516203 | 464:1 | 75 | 16.1372 |
| Two Pair | 0.62919555 | 158:1 | 25 | 15.7299 |
| Total | 1.20590593 | 82:1 | | 84.6468 |

Approximately once every 83 hands the player will be bad beat. The house advantage is 100%−84.6468%−1.2059%=14.1473%.

A computer simulation of 800 million hands was run to verify the accuracy of the analysis.

| Summary of House Advantages | |
|---|---|
| Primary Bet | 3.2190% (1.8848% per total wager) |
| Bonus Bet (1) | 5.0069% |
| Bonus Bet (2) | 6.8788% |
| Bad Beat Side Bet | 14.1473% |

The mathematical analysis for five card poker games, as well as three card poker games are known in the art. It will be appreciated, therefore, that by comparing a players odds of winning a four card game against a five card game shows that the player odds of winning are enhanced by a significant margin. In the same light, the players odds of winning in a four card game are more difficult than any three card game, and in this manner, higher payouts are justified in a four card game, over a three card game. However, in view of the fact that the players odds of winning a four card game are enhanced, there is greater interest in such a game and will therefore entice more players to play a four card game than a five card game.

While there has been described what is considered to be a preferred embodiment of the invention, it will be understood that various modifications may be made therein and it is intended to cover in the intended claims all such obvious modifications and variations.

The invention claimed is:

1. A method of playing a wagering game including a dealer and at least one player comprising the steps of:

(a) providing at least one standard deck of 52 playing cards;

(b) providing a published ranking of winning four-card poker hands;

(c) providing a predetermined pay scale for winning hands;

(d) providing a dealer and at least one player;

(e) commencing the game by having the at least one player make certain initial wagers selected from the following;

(1) a first wager against the dealer, and (2) a separate voluntary wager against the predetermined pay scale;

(f) dealing at least four cards to the at least one player from the at least one standard deck;

(g) dealing at least four cards to the dealer from the at least one standard deck;

(h) said at least one player proceeding to play the game by placing a support wager in support of its first wager against the dealer;

(i) comparing the at least one player's best four card hand against the dealer's best four card hand and excluding all extra cards dealt to determine a relative ranking therebetween as a final outcome of the wagering game;

(j) paying the at least one player's first wager against the dealer and the at least one player's support wager if the at least one player's hand outranks the dealer's hand;

(k) paying the at least one player's separate voluntary wager against the predetermined pay scale if the at least one player's hand has achieved a rank at least as high as the first ranking from said published ranking;

(l) taking the at least one player's separate voluntary wager against the predetermined pay scale if the at least one player's hand fails to achieve at least the minimum ranking from said published ranking;

(m) taking the at least one player's first wager against the dealer and support wager if the dealer's hand outranks the at least one player's hand; and (n) returning the at least one player's first wager against the dealer and support wager if said at least one player has the same ranking hand as the dealer wherein the dealer must achieve a qualifying hand to continue playing and the failure to achieve said qualifying hand results in the dealer losing and paying the at least one player the first wager by the at least one player against the dealer, and wherein the dealer achieving said qualifying hand results in the dealer comparing its best four-card hand against the player's best four-card hand and paying the player, based on an optional second bet against the dealer by the player, when the player's best four card hand outranks the dealer's best four-card hand.

2. The method of playing a wagering game as set forth in claim 1 above, which provides for the at least one player to place an additional side bet, wherein the method further includes steps of:

providing the at least one player with an additional optional progressive wager for a five card progression, providing a predetermined published ranking of winning five card progressive hands, providing a predetermined pay scale for each of said predetermined ranking of winning five card progressive hands, allowing the wagering game to continue with the best of four cards, and paying the at least one player's progressive optional wager if the at least one player's five card hand matches any one of the predetermined published ranking of winning five card progressive hands.

3. The method of playing a wagering game as set forth in claim 1 above, wherein the qualifying hand required by the dealer in order to continue to play comprises king high with a queen.

4. The method of playing a wagering game as set forth in claim 1 above, further including steps of:

providing a set predetermined minimum hand ranking for the dealer to achieve as a qualifying hand without which the dealer will lose after all cards are dealt;

ending the game if the dealer fails to achieve the qualifying hand in accordance with said predetermined minimum hand ranking and the dealer paying the at least one player's first wager if the at least one player placed the first wager against the dealer and paying the at least one player's separate voluntary wager if the at least one player waged the separate voluntary wager against the predetermined pay scale and achieved a ranking hand pursuant to said published ranking; and proceeding with the game if the dealer has achieved the qualifying hand.

5. The method of claim 1, wherein the support wager is of proportionate value to the first wager.

6. A method of playing a wagering game including a dealer and at least one player comprising the steps of:

(a) providing at least one standard deck of 52 playing cards;

(b) providing a published ranking of winning hands;

(c) providing a predetermined pay scale for winning hands;

(d) providing a set predetermined minimum hand ranking for a dealer to achieve as a qualifying hand without which a dealer will lose after all cards are dealt;

(e) providing at least one player;

(f) commencing the game by having the at least one player make certain initial wagers selected from the following;

(1) a first wager against the dealer, and (2) a separate voluntary wager against the predetermined pay scale;

(g) dealing at least four cards to the at least one player from the at least one standard deck;

(h) dealing at least four cards to the dealer from the at least one standard deck;

(i) ending the game if the dealer fails to achieve a qualifying hand in accordance with said predetermined minimum hand ranking and paying the at least one player based on the at least one player's first wager;

(j) proceeding with the game if the dealer has achieved said qualifying hand;

(k) said at least one player proceeding to play the game by placing a support wager in support of its first wager against the dealer;

(l) comparing the at least one player's best four card hand against the dealer's best four card hand and excluding all extra cards dealt to determine a relative ranking therebetween;

(m) paying the at least one player's first wager against the dealer and the at least one player's support wager if the at least one player's hand outranks the dealer's hand;

(n) paying the at least one player's separate voluntary wager against the predetermined pay scale if the at least one player's hand has achieved a rank at least as high as the first ranking from said published ranking; and (o) taking the at least one player's separate voluntary wager against the predetermined pay scale if the at least one player's hand fails to achieve at least the minimum ranking from said published ranking.

7. The method of playing a wagering game as set forth in claim 6 above, further including steps of:

(p) taking the at least one player's first wager against the dealer and support wager if the dealer's hand outranks the at least one player's hand; and (q) returning the at least one player's first wager against the dealer and support wager if said at least one player has the same ranking hand as the dealer.

8. The method of claim 6, wherein the support wager is of proportionate value to the first wager.

* * * * *